United States Patent [19]

Alessi et al.

[11] Patent Number: 4,821,934

[45] Date of Patent: Apr. 18, 1989

[54] PLASTIC SUPPORT CLIP HAVING A RETAINING HOOK FOR RELEASABLY RETAINING AN ARTICLE WITHIN THE CLIP

[75] Inventors: Louis F. Alessi, Amherst; Charles E. Ritchie, Jr., Kenmore, both of N.Y.

[73] Assignee: Alessi Holsters, Inc., Tonawanda, N.Y.

[21] Appl. No.: 49,965

[22] Filed: May 15, 1987

[51] Int. Cl.[4] ..... A44B 13/02; A44B 21/00

[52] U.S. Cl. ..... 224/252; 24/3 L; 224/904; 224/911; 224/912

[58] Field of Search ..... 24/316, 338, 346, 3 R, 24/3 L, 3 J, 3 G; 224/904, 911, 912, 192, 198, 224, 238, 252, 253, 268, 269

[56] References Cited

U.S. PATENT DOCUMENTS

| | | | |
|---|---|---|---|
| 118,228 | 8/1871 | Frey | 224/252 |
| D. 273,821 | 5/1984 | Bianchi | D11/215 X |
| 307,655 | 11/1884 | Jacob | 224/252 |
| 541,384 | 6/1895 | Pascoe | 24/346 X |
| 1,113,590 | 10/1914 | Williamson | 224/252 |
| 1,206,074 | 11/1916 | Zwiener et al. | 224/252 X |
| 1,618,573 | 2/1927 | Cole | 224/252 X |
| 1,652,972 | 12/1927 | Beck | 24/3 L |
| 2,138,978 | 12/1938 | Meine | 224/252 |
| 2,783,536 | 3/1957 | McQueary | 224/253 X |
| 3,250,448 | 5/1966 | Clark | 224/252 |
| 3,300,109 | 1/1967 | Clark | 224/252 |
| 3,357,615 | 12/1967 | Hill | 224/268 |
| 3,561,066 | 2/1971 | Osteen | 24/3 L |
| 3,836,045 | 9/1974 | Duhy et al. | 220/270 X |
| 4,044,933 | 8/1977 | Artz | 224/252 X |
| 4,444,342 | 4/1984 | Powell | 224/252 |
| 4,619,020 | 10/1986 | Lecher, Sr. | 224/252 X |
| 4,627,558 | 12/1986 | Bianchi et al. | 224/238 |
| 4,667,374 | 5/1987 | Bianchi | 24/3 J |
| 4,676,419 | 6/1987 | Victor | 224/252 |

FOREIGN PATENT DOCUMENTS

| | | | |
|---|---|---|---|
| 823409 | 11/1959 | United Kingdom | 224/252 |

*Primary Examiner*—Henry J. Recla
*Assistant Examiner*—Ernest G. Cusick
*Attorney, Agent, or Firm*—Bean, Kauffman & Bean

[57] ABSTRACT

A support clip particularly adapted to removably support a first article, such as a holster, magazine pouch, badge or identification holder, canteens, and other equipment, relative to a second article, such as a belt or other article of apparel, comprises an integrally formed injection molded plastic body of generally U-shaped configuration, wherein first and second leg portions are resiliently interconnected by a connecting portion, the first leg portion is attached to the first article and the second leg portion carries a hook portion, which defines a concave surface arranged to face the connecting portion and has a free end portion normally biased into engagement with the first leg portion.

9 Claims, 1 Drawing Sheet

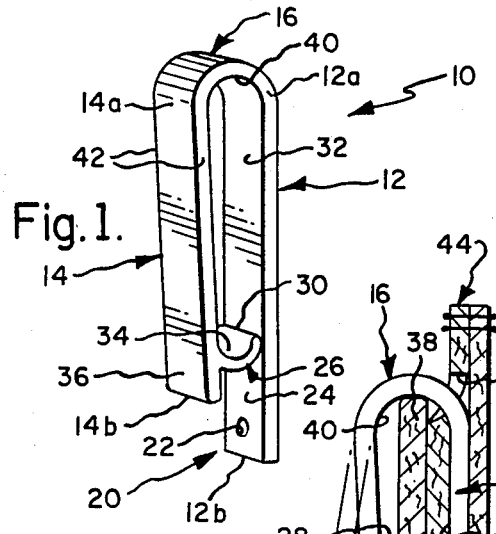
Fig. 1.
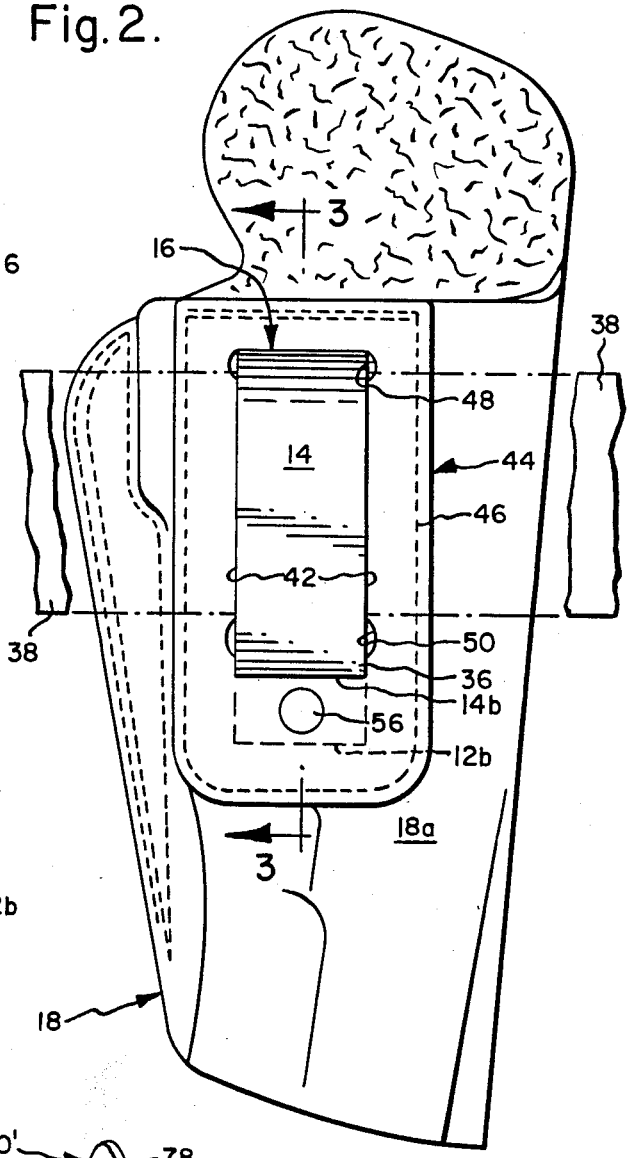
Fig. 2.
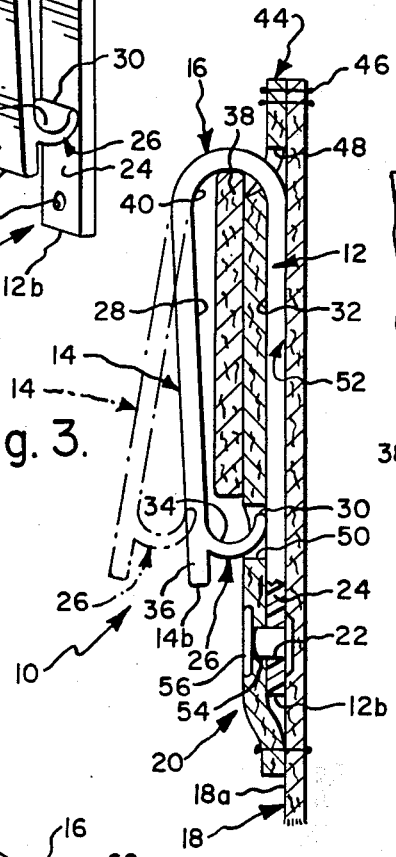
Fig. 3.
Fig. 4.
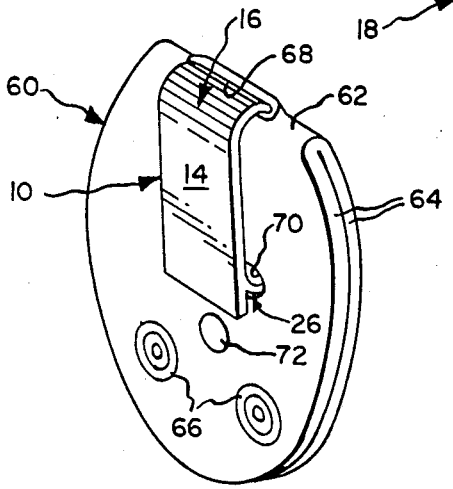
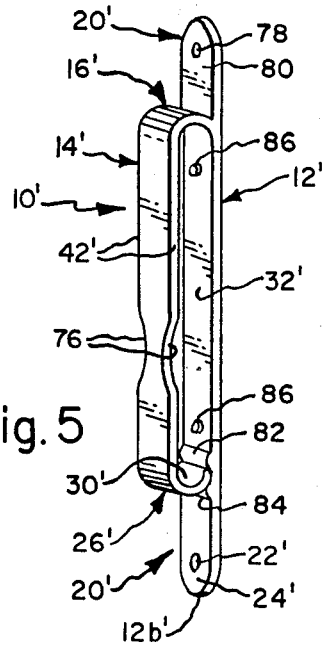
Fig. 5
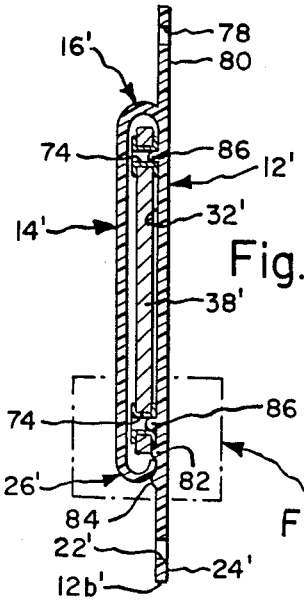
Fig. 6.
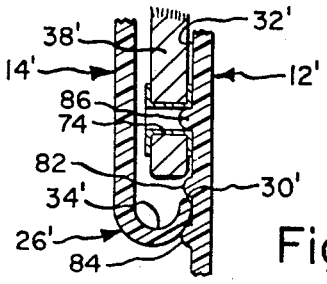
Fig. 7.
Fig. 7.

PLASTIC SUPPORT CLIP HAVING A RETAINING HOOK FOR RELEASABLY RETAINING AN ARTICLE WITHIN THE CLIP

BACKGROUND OF THE INVENTION

The present invention relates to support clips and more particularly to support clips adapted to releasably mount or attach articles, such as holsters, magazine pouches, badge or identification holders, canteens, and other equipment, to belts or other articles of apparel.

For many years, integrally formed spring metal clips have been available for use in releasably attaching a holster to a belt. Such clips are generally U-shaped in form and have a first leg portion adapted to be attached to the holster and a second leg portion bent to define a locking tap releasably biased into engagement with the first leg portion for purposes of removably retaining a belt within the clip. A relatively recent form of this type of clip is disclosed in U.S. Pat. No. Des. 273,821. Spring metal clips are known to be susceptible to being permanently bent out of shape such that their holster retaining function is destroyed, and to unintended release of the clip from a belt when upwardly directed forces are applied to the clip via the holster.

In an effort to positively prevent unintended release of a holster supporting clip from a belt, it has also been proposed to provide a support clip with a positive latching device or lock, such as that disclosed for instance in U.S. Pat. No. 4,627,558. However, an obvious drawback of this type of support clip is its complex multi-part construction.

SUMMARY OF THE INVENTION

The present invention is directed towards an integrally formed, injection molded plastic support clip, which is adapted to positively retain a first article, such as a holster, in association with a second article, such as a belt, while permitting a user to quickly release the clip from the belt whenever the user desires to do so.

A support clip formed in accordance with the present invention is characterized as having a generally U-shaped configuration defined by generally flat first and second leg portions joined adjacent first ends thereof by a curved connecting portion normally tending to resiliently bias second ends of the leg portions towards one another. The first leg portion is provided with suitable means, such as a rivet receiving aperture, for use in attaching the support clip to a first article, such as a holster. The second leg portion carries a retaining hook adjacent its second end, which has a curved surface arranged to face towards the connecting portion and a free end normally retained in engagement with the first leg portion, and an end operating tab manually engageable by a user for purposes of moving the retaining hook from engagement with the first leg portion.

A second or alternative clip construction is disclosed as being particularly adapted for use in releasably attaching holsters and other desired equipment to a conventional military field style belt of the type fitted with two or more rows of paired equipment mounting apertures designed to removably receive equipment attachment hook devices.

BRIEF DESCRIPTION OF THE DRAWINGS

The nature and mode of operation of the present invention will now be more fully described in the following detailed description taken with the accompanying drawings wherein:

FIG. 1 is a perspective view of a support clip formed in accordance with the present invention;

FIG. 2 is a side elevational view of the support clip shown as being employed to support a holster on a belt;

FIG. 3 is a sectional view taken generally along the line 2—2 in FIG. 1;

FIG. 4 is a perspective view showing the support clip in association with a badge or identification holder FIG. 5 is a perspective view of an alternative clip construction;

FIG. 6 is a vertical sectional view taken centrally through the support clip of FIG. 5 showing same in association with a miliary equipment supporting web type belt; and FIG. 7 is an enlarged view of the area designated as FIG. 7 in FIG. 6.

DESCRIPTION OF THE PREFERRED EMBODIMENT

Reference is first made to FIG. 1, wherein a molded plastic support clip formed in accordance with the present invention is designated as 10 and shown as having a generally U-shaped configuration defined by first and second leg portions 12 and 14 having first ends **12*a* and 14*a* interconnected by a connecting portion 16 and free second ends 12*b* and 14*b***.

First leg portion 12 is intended to be attached to a first article, such as an "inside-the-pants" holster designated as 18 in FIGS. 2 and 3, and to this end leg portion 12 is provided with attachment means 20 formed for instance by a mounting aperture 22 arranged in a portion 24 of second end **12*b* disposed to project beyond second end 14*b***.

Second leg portion 14 is provided with a retaining hook 26, which projects from its inner surface 28 and terminates in a free end 30 arranged for abutting engagement or in close proximity with the inner surface 32 of first leg portion 12. As best shown in FIGS. 1 and 3, retaining hook 26 is provided with a concave surface or recess 34, which is arranged to face towards connecting portion 16, and is joined to second leg portion 14 in a spaced relationship from second end **14*b*, so as to define clip release means in the form of a release tab 36**.

Preferably, clip 10 is formed by an injection molding operation beginning with a mixture of Nylon and fiberglass pellets, which after heating is injected under high pressure into a mold. A formula consisting of 70% Nylon pellets and 30% fiberglass pellets has been found to provide a proper spring temper for clips of the type intended for use in supporting holster 18 in the manner shown in FIG. 3. However, the formula may be varied to meet the needs of specific application, that is, to vary the bias exerted by connecting portion 16 tending to move second ends **12*b* and 14*b* towards one another for purposes of retaining a second article, such as belt 38, within the confines of the clip intermediate retaining hook 26 and the connecting portion. Preferably, the mold employed in forming clip 10 is designed to provide that degree of initial spacing between retaining hook free end 30 and first leg portion inner surface 32**, as will allow the retaining hook to be moved into abutting engagement with the first leg portion, as an incident to cooling/contraction of the clip upon discharge from the mold.

Further, in the preferred construction of clip 10, leg portions 12 and 14 are of generally rectangular plan view form and have like cross-sectional configurations; and connecting portion 16 is curved, as viewed on edge, to provide a concave surface 40 arranged to face towards retaining hook surface 34, and has a cross-sectional configuration essentially corresponding to that of the leg portions. Retaining hook 26 is preferably sized to extend transversely between the lengthwise extending marginal edges 42 and 42 of second leg portion 14, and has a cross-sectional configuration corresponding essentially to that of the second leg portion, but may decrease slightly in thickness in a direction extending towards free end 30.

Now referring particularly to FIGS. 2 and 3, it will be noted that holster 18 is formed from a sheet of leather or the like to define an open-ended pouch sized/shaped to receive a desired handgun, not shown. With this type of holster construction, clip 10 is attached with the aid of a generally rectangular piece of leather 44, which is fastened, as by a peripherally extending line of stitching 46, to one major or outer face 18*a* of the holster. Piece 44 is provided with parallel upper and lower slots 46 and 50, which are placed in communication by a flat internal passage 52 defined by the inner surface of piece 44 and major face 18*a*, and an aperture 54 arranged relatively below slot 50. Slots 48 and 50 are spaced and sized to receive connecting portion 16 and retaining hook free end 30, when first leg portion 12 is disposed within passage 52; and aperture 54 is spaced from lower slot 50 for alignment with mounting aperture 22 when retaining hook free end 30 is aligned with the lower slot. Apertures 22 and 54 are maintained in alignment and clip 10 permanently fixed to piece 44 by a rivet 56 extending therethrough. To facilitate assembly of clip 10, piece 44 and holster 18, the clip is preferably fixed to the piece by rivet 56 prior to attaching such piece to the holster.

Again referring to FIG. 3, it will be understood that a user may removably support holster 18 on belt 38 by applying finger pressure against the inner surface of release tab 36 to move retaining hook free end 30 out of lower slot 50 sufficiently to permit insertion of the belt lengthwise of leg portions 12 and 14 past hook portion 26 and into a position intermediate such hook portion and connecting portion 16. Upon release of tab 36, retainng hook free end 30 is resiliently biased for return to seating engagement within lower slot 50. It will be noted that the provision of lower slot 50, insures that retaining hook free end 30, and thus any narrow space or opening existing between such free end and first leg portion inner surface 32 due for instance to the thickness of belt 38 being slightly greater than the distance between the outer surface of piece 44 and second leg portion inner surface 28, is normally hidden relative to the belt. Thus, belt 38 can only "see" and engage within concave surface 34 and cannot unintentionally escape from within the confines of clip 10, even in the event that a momentary excessive upwardly directed pull applied to holster 18 is sufficient to deform the clip and temporarily remove retaining hook free end 30 from within the confines of lower slot 50.

As by way of further illustrating the utility of clip 10, reference is now made to FIG. 4, wherein the clip is shown as being attached to a badge or identification holder 60 and adapted to mount same on a belt or other desired article of apparel, such as the flap of a suit coat breast pocket, not shown. As by way of example, holder 60 may be formed from a single piece of leather, which is folded along a fold line 62 to define a pair of facing pieces 64 and 64 releasably connected in a face to face relationship by snap fasteners 66 and 66. In this construction, an upper slot 68 is formed in the area of fold line 62 for purposes of receiving connecting portion 16 and a lower slot 70 spaced therefrom for alignment with retaining hook 26. A rivet 72 is again employed to attach clip 10 in desired position.

Reference is now made to FIGS. 5, 6 and 7, which illustrate a second embodiment of the present invention particularly adapted to mount equipment, such as holsters, canteens, magazine pouches, etc., on a conventional military field style belt 38' of the type having at least two parallel rows of paired mounting apertures extending lengthwise of the belt; only one aligned pair of such aperture being shown at 74 and 74 in FIG. 6. In that the clip shown in FIGS. 5 and 6 is similar in construction to previously described clip 10, it is designated as 10' and primed numerals are used to designate parts thereof corresponding to those of clip 10.

As in the case of clip 10, clip 10' includes first and second leg portions 12' and 14' joined adjacent first ends thereof by a curved connecting portion 16' and a retaining hook 26' having a free end 30' and a concave surface or recess 34' arranged to face towards the connecting portion.

Clip 10' differs from clip 10 in that its clip release means is preferably defined by a pair of user finger receiving recesses 76 and 76 formed in the lengthwise extending marginal edges 42' and 42' of second leg portion 14' intermediate retaining hook 26' and connecting portion 16'. While for any given size clip, clip 10' is more difficult to operate than clip 10, it is nonetheless believed desirable to avoid the use of a release tab similar to tab 36, which might be snagged in the field and possibly result in damage to clip 10' and/or unintended release of retaining hook 26'. Clip 10' also differs from clip 10 in that attachment means 20' preferably includes, in addition to aperture 22' provided in position 24', a second aperture 78 provided in a tab portion 80 extending as a projection of first leg portion 12' outwardly beyond connecting portion 16'. The provision of additional aperture 78 allows clip 10' to be attached to lie wholly exteriorly of holsters and equipment pouches attached to belt 38', so as to avoid the need to provide same with upper and lower slots of the type discussed with reference to FIGS. 2, 3 and 4. However, the absence of a lower slot to receive retaining hook free end 30' has the drawback that the latter can be "seen" by belt 38' and might possibly result in unintended opening of clip 10' under certain conditions. To avoid this potential problem, first leg portion 12' is provided with safety means 82 preferably in the form of a rib arranged to extend transversely of and project from inner surface 32' at a point immediately adjacent retaining hook free end 30' intermediate such free end and connecting portion 16'. Safety means 82 serves to direct belt 38' into engagement with concave surface 34' in the event of movement of the belt within clip 10' relatively towards the free ends of leg portions 12' and 14'. With the edge of belt 38' captured by concave surface 34', even flexures of clip 10' sufficient to move retaining hook free end 30' substantially away from first leg portion 12' and beyond safety means 82, will now allow the belt to escape from within the confines of the clip. It is also preferable to provide first leg portion 12' with an additional or second safety means 84, which may be in the form of a rib extending transversely of and projecting from inner surface 32' parallel to the first safety means 82 immediately adjacent retaining hook free end 30′ and intermediate same and first leg portion second end 12*b*′. Safety means 82 and 84 cooperate to define a recess or "cradle" shielding the retaining hook from external opening forces.

Again referring to FIGS. 5, 6 and 7, it will be noted that the illustrated form of clip 10′ differs further from clip 10 in that at least one of leg portions 12′ and 14′ and preferably first leg portion 12′ is formed with at least one pair of clip positioning projections 86 and 86, which project from its inner surface for releasable receipt within belt mounting apertures 74 and 74. Projections 86 and 86 serve to selectively position clip 10′ both lengthwise and transversely of belt 38′.

While the present support clip was designed and has been disclosed primarily for use in removably attached holsters and other equipment to belts or other articles of apparel, it is anticipated that such clip has wider application. Thus, rather than permanently attaching the clip to a first article, such as a holster, intended to be removably attached to a second article, such as a relatively fixed supporting belt, the clip may be inverted relative to its orientation depicted in the drawings and permanently fixed to a relatively stationary article intended to removably support another article.

What is claimed is:

1. A support clip for removably connecting a first article to a second article, said clip comprising:

an integrally formed molded plastic body having first and second leg portions arranged in a facing relationship and having first and second ends and facing inner surfaces, a connecting portion joining said first ends and possessing resiliently deformable spring properties for establishing a bias tending to move said second ends of said leg portions towards one another, said first leg portion includes means for attaching said clip to said first article, and a retaining hook carried by said second leg portion to project towards said first leg portion, said hook having a concave surface facing towards said connecting portion and a free end positioned immediately adjacent said inner surface of said first leg portion, said second leg portion defining release means manually engageable by a user to move said retaining hook away from said first leg portion against said bias to permit removable insertion of said second article lengthwise of said first and second leg portions past said retaining hook into a position intermediate said retaining hook and said connecting portion, said first end of said first leg portion includes a projecting portion projecting beyond said connecting portion in a direction away from said second end of said first leg portion and said means for attaching said clip includes at least one mounting aperture extending through said projecting portion.

2. A support clip according to claim 1, wherein said second end of said first leg portion projects beyond said second end of said second leg portion in a direction away from said connecting portion, and said means for attaching said clip additionally includes at least one mounting aperture extending through that portion of said first leg portion projecting beyond said second end of said second leg portion.

3. A support clip for removably connecting a first article to a second article, said clip comprising:

an integrally formed molded plastic body having first and second leg portions arranged in a facing relationship and having first and second ends and facing inner surfaces, a connecting portion joining said first ends and possessing resiliently deformable spring properties for establishing a bias tending to move said second ends of said leg portions towards one another, said first leg portion includes means for attaching said clip to said first article, and a retaining hook carried by said second leg portion to project towards said first leg portion, said hook having a concave surface facing towards said connecting portion and a free end positioned immediately adjacent said inner surface of said first leg portion, said second leg portion defining release means manually engageable by a user to move said retaining hook away from said first leg portion against said bias to permit removably insertion of said second article lengthwise of said first and second leg portions past said retaining hook into a position intermediate said retaining hook and said connecting portion, said first leg portion is formed with a safety means projecting from said inner surface thereof in a direction towards said second leg portion, and said safety means is positioned immediately adjacent said free end of said retaining hook intermediate said free end and said connecting portion for diverting said second article into engagement with said concave surface of said retaining hook when said second article is moved along said inner surface of said first leg portion relatively towards said second end thereof.

4. A support clip according to claim 3, wherein at least one of said first and second leg portions has at least one pair of clip positioning projections projecting from an inner surface thereof.

5. A support clip according to claim 4, wherein said first leg portion includes a projecting portion projecting beyond said connecting portion in a direction away from said second end thereof, said second end of said first leg portion projects beyond said second end of said second leg portion in a direction away from said connecting portion, and said means for attaching said clip includes at least one mounting aperture extending through each of said projecting portion and said second end of said first leg portion.

6. A support clip according to claim 5, wherein said release means is defined by a pair of user finger receiving recesses formed in lengthwise extending marginal edges of said second leg portion intermediate said retaining hook and said connecting portion.

7. A support clip according to claim 3, wherein said first leg portion isformed with an additional safety means projecting from said inner surface of said first leg portion in a direction towards said second leg portion, and said additional safety means is positioned immediately adjacent said free end of said retaining hook intermediate said free end and said second end of said first leg portion.

8. A support clip according to claim 4, wherein said safety means and said additional safety means are rib-like projections projecting from said inner surface of said first leg portion and extending transversely thereof.

9. A support clip for removably connecting a first article to a second article, said clip comprising:

an integrally formed molded plastic body having first and second leg portion arranged in a facing relationship and having first and second ends and facing inner surfaces, a connecting portion joining said first ends and possessing resiliently deformable spring properties for establishing a bias tending to move said second ends of said leg portions towards one another, said first leg portion includes means for attaching said clip to said first article, and a retaining hook carried by said second leg portion to project towards said first leg portion, said hook having a concave surface facing towards said connecting portion and a free end position immediately adjacent said inner surface of said first leg portion, said second leg portion defining release means manually engageable by a user to move said retaining hook away from said first leg portion against said bias to permit removable insertion of said second article lengthwise of said first and second leg portions past said retaining hook into a position intermediate said retaining hook and said connecting portion, said release means is defined by a pair of user finger receiving recesses formed in lengthwise extending marginal edges of said second leg portion intermediate said retaining hook and said connecting portion, said first leg portion includes a projection portion projecting beyond said connecting portion in a direction away from said second end thereof, said second end of said first leg portion projects beyond said second end of said first portion in a direction away from said connecting portion, and said means for attaching said clip includes at least one mounting aperture extending through each of said projecting portion and said second end of said first leg portion.

* * * * *